US007024833B1

(12) United States Patent
Rice

(10) Patent No.: US 7,024,833 B1
(45) Date of Patent: Apr. 11, 2006

(54) BRACKET FOR CONCRETE FORMS

(75) Inventor: John Rice, Concord (CA)

(73) Assignee: International Steel Corporation, Antigua (KN)

( * ) Notice: Subject to any disclaimer, the term of this patent is extended or adjusted under 35 U.S.C. 154(b) by 0 days.

(21) Appl. No.: 09/420,419

(22) Filed: Oct. 19, 1999

(30) Foreign Application Priority Data

Oct. 18, 1998 (CA) ..... 2251310

(51) Int. Cl.
*B65B 55/04* (2006.01)

(52) U.S. Cl. ..... 52/426; 52/702

(58) Field of Classification Search ..... 52/702, 52/426, 431, 442, 677, 714, 742.14, 745.1, 52/745.13; 403/232.1; 248/679, 300, 220.1; 249/30

See application file for complete search history.

(56) References Cited

U.S. PATENT DOCUMENTS 4,348,847 A * 9/1982 Jukes ..... 52/426
5,274,981 A * 1/1994 Comkins ..... 403/232.1 X
5,598,675 A * 2/1997 Pruss ..... 52/426 X
5,598,680 A * 2/1997 Wilhelmi ..... 248/300 X
5,810,303 A * 9/1998 Bourassa et al. ..... 248/300 X
5,852,907 A * 12/1998 Tobin et al. ..... 52/431
5,890,337 A * 4/1999 Boeshart ..... 52/426
5,987,830 A * 11/1999 Worley ..... 52/426

OTHER PUBLICATIONS

Simpson Strong-Tie Connectors, p. 48, Jan. 1996.*

* cited by examiner

*Primary Examiner*—Jose V. Chen

(57) ABSTRACT

A bracket for use with insulated forms for concrete walls for attaching header or rim joists to the concrete walls. The bracket has an attachment plate for overlying the exterior of the insulated form to provide for a means of attaching the header or rim joist to the bracket. The bracket is provided with an anchoring plate extending from the attaching plate for insertion into the interior of the insulated form. A method of attaching a header or rim joist to a concrete wall formed using insulated forms is also provided. The method involves cutting a vertical slot in the insulated form and insterting a bracket into the slot. The bracket has an attachment plate for overlying the exterior surface of the insulated form and an anchoring plate extending from the attachment plate through the slot into the interior of the insulated form. Concrete is poured into the form and allowed to set, after which the header or rim joist is attached to the brackets.

18 Claims, 10 Drawing Sheets

12
14
46
48
30
32

BRACKET FOR CONCRETE FORMS

FIELD OF THE INVENTION

The present invention is directed to a bracket for use with insulated concrete forms to allow for ease of attachment of headers for floor structures to the formed wall.

BACKGROUND OF THE INVENTION

The use of forms for pouring of concrete walls has been common in the construction industry for many years. In conventional construction, the concrete walls are produced by constructing form walls, pouring concrete into the space between the walls and, upon setting of the concrete, removing the form walls. Finishing materials may then be added to the concrete walls as required. As it is common, especially in colder climates, to insulate concrete walls, additional framing and insulation must be installed separately inside the walls.

In recent years specialized forms for concrete walls have been developed. The specialized forms are provided as two foam insulating blocks spaced apart the required distance by specialized metal or plastic bridging members. The insulating blocks are generally formed of expanded polystyrene and plastic or metal bridging members are provided to securely hold the insulating blocks in place when the concrete is poured in the hollow cavity and to tie the insulating blocks to the concrete. Once the concrete has been poured and set, the form walls are left in place to provide for the necessary insulation. If desired, finishing materials may be applied to the exterior surface of such walls. Examples of such concrete formwork assemblies are illustrated in U.S. Pat. Nos. 4,655,014, 4,706,429, 4,731,968, 4,884,382, 4,889,310, 5,390,459 and 5,809,728. While each of these designs utilizes the basic setup of the two foam blocks of polystyrene tied together with the metal or plastic bridging members, each of the designs has certain variations. A number of the designs are provided with interlocking means along the edges of the polystyrene blocks to interlock the blocks together when forming a complete concrete form. In addition, the attachment of the bridging members to the polystyrene blocks varies from design to design. In some of the designs the bridging members are provided with exterior plates which overlay the exterior wall of the polystyrene block. Other designs utilize structures which are held within the polystyrene block itself such that the bridging member is not exposed to the exterior of the wall.

Some of the designs of the specialized forms utilize plastic or metal bridging members having recesses or hooked structures, which provide for a means for attaching reinforcing bars or Rebar to the bridging members. This increases the strength of the poured concrete wall and also allows for using the forms for multistory buildings.

When the forms are used in a multistory building a means for attaching the header or rim joist for the floor structure must be provided. In the past this means of attachment of the header or rim joist has required that the insulation be removed in the area where the attachment is to be made. A spacer plate is then attached to the exterior wall, the spacer plate holding anchor bolts typically used for attachment of sill plates to a concrete wall. The anchor bolts are held on the spacer plate with suitable nuts and the shanks of the bolts extend inwardly into the hollow cavity. Once the concrete has been poured and the bolts have been secured within the concrete, the plate is removed and the header or rim joist is attached to the bolts by suitable nuts. This means of attachment is relatively labor-intensive, as it requires the installer to remove a portion of the insulation, attach the plate and the bolts and then once the concrete is poured and set, remove the plate from the forms. The anchor bolts are generally provided about every three or four feet around the periphery of the wall so there are quite a number of these operations required for a typical wall. When the header joist is to be attached to the wall, it is necessary to accurately locate the position of the bolts on the header or rim joist so that holes may be drilled in the header or rim joist. This can also be a tedious and labor-intensive operation especially for long headers or rim joists. There thus remains a need for an easier means of attaching headers and rim joists to concrete walls formed with insulated forms.

SUMMARY OF THE INVENTION

The present invention provides in one aspect for a bracket for use with insulated forms for concrete walls for attaching a header or rim joist to the wall. The bracket has an attachment plate for overlying the exterior of the insulated form for attaching a header or rim joist to the bracket. The bracket is also provided with an anchoring plate extending from the attachment plate for insertion into the interior of the insulated form to anchor the bracket in the concrete.

The present invention also provides for a method of attaching a header or rim joist to a concrete wall formed using insulated forms. The method comprises cutting a vertical slot in the insulated form and inserting a bracket into the slot. The bracket has an attachment plate for overlying the exterior surface of the insulated form and an anchoring plate extending from the attachment plate through the slot into the interior of the insulated form. Concrete is poured into the form and allowed to set, after which the header or rim joist is attached to the brackets.

BRIEF DESCRIPTION OF THE DRAWINGS

Preferred embodiments of the present invention are illustrated in the attached drawings in which.

DETAILED DESCRIPTION OF THE PREFERRED EMBODIMENTS

Figure 1:
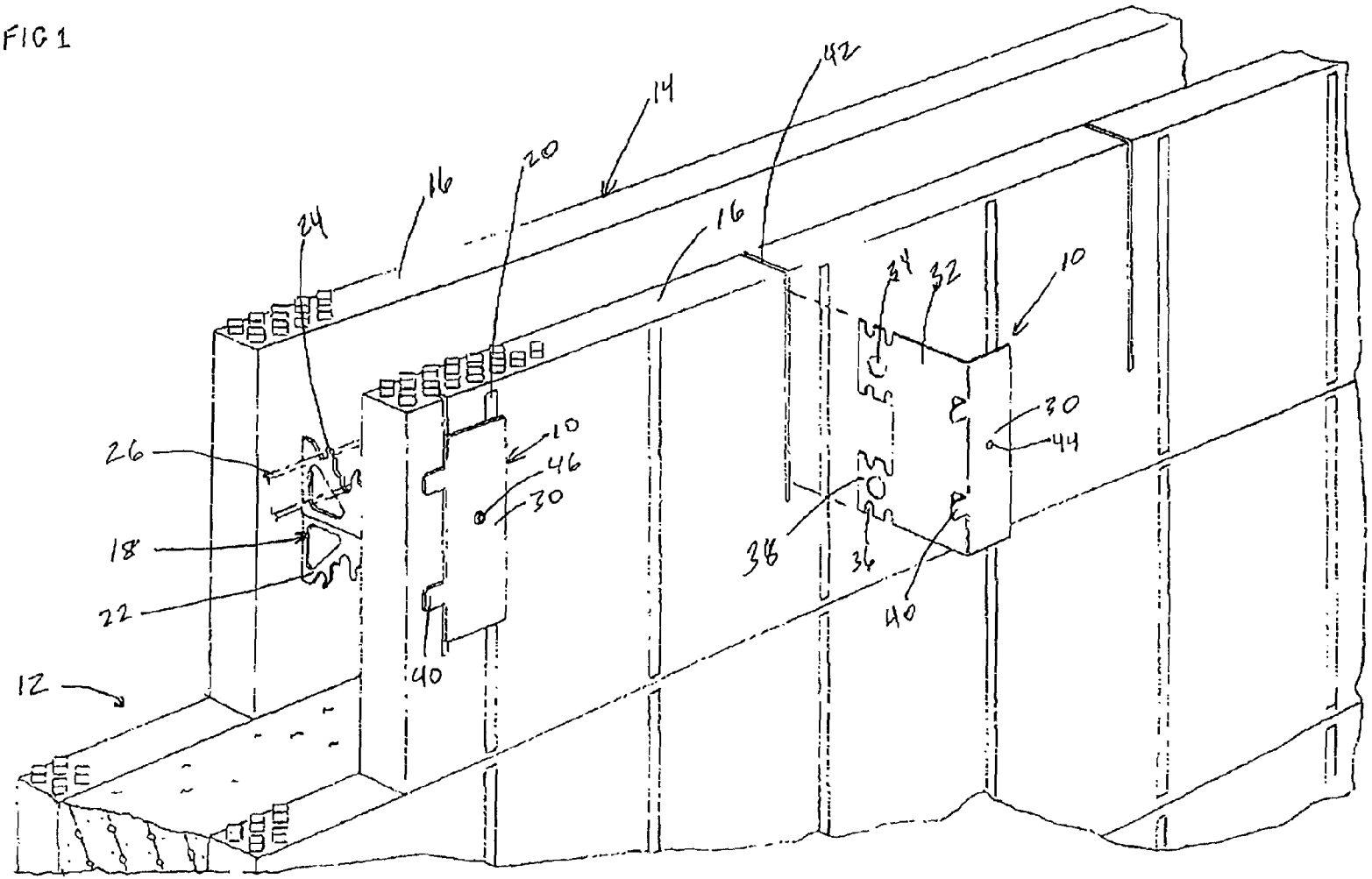
FIG. 1 is a perspective view of a concrete wall illustrating the use of the bracket of the present invention.
Figure 2:
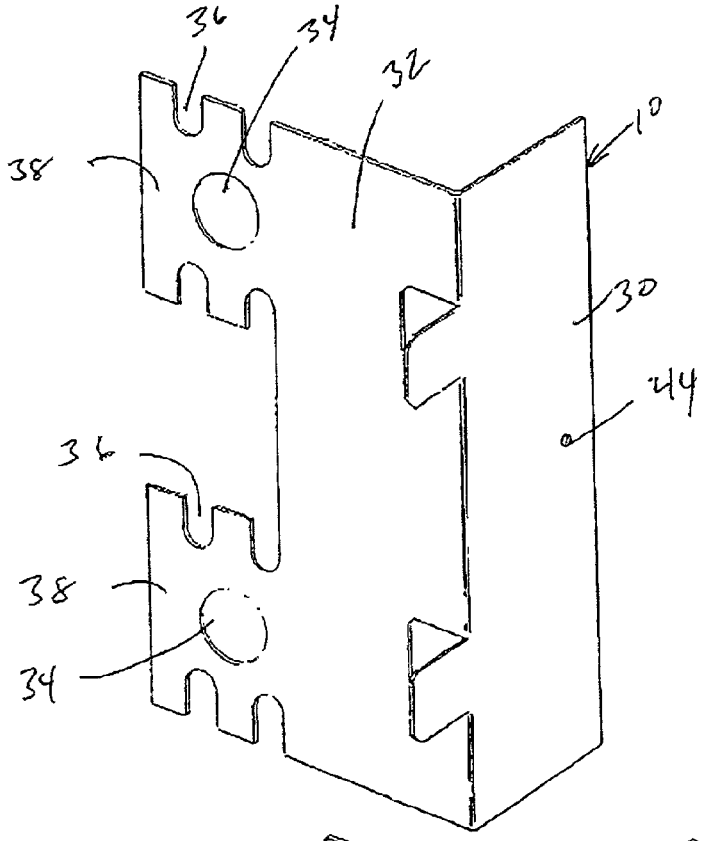
FIG. 2 is a perspective view of a first embodiment of the bracket of the present invention.
Figure 3:
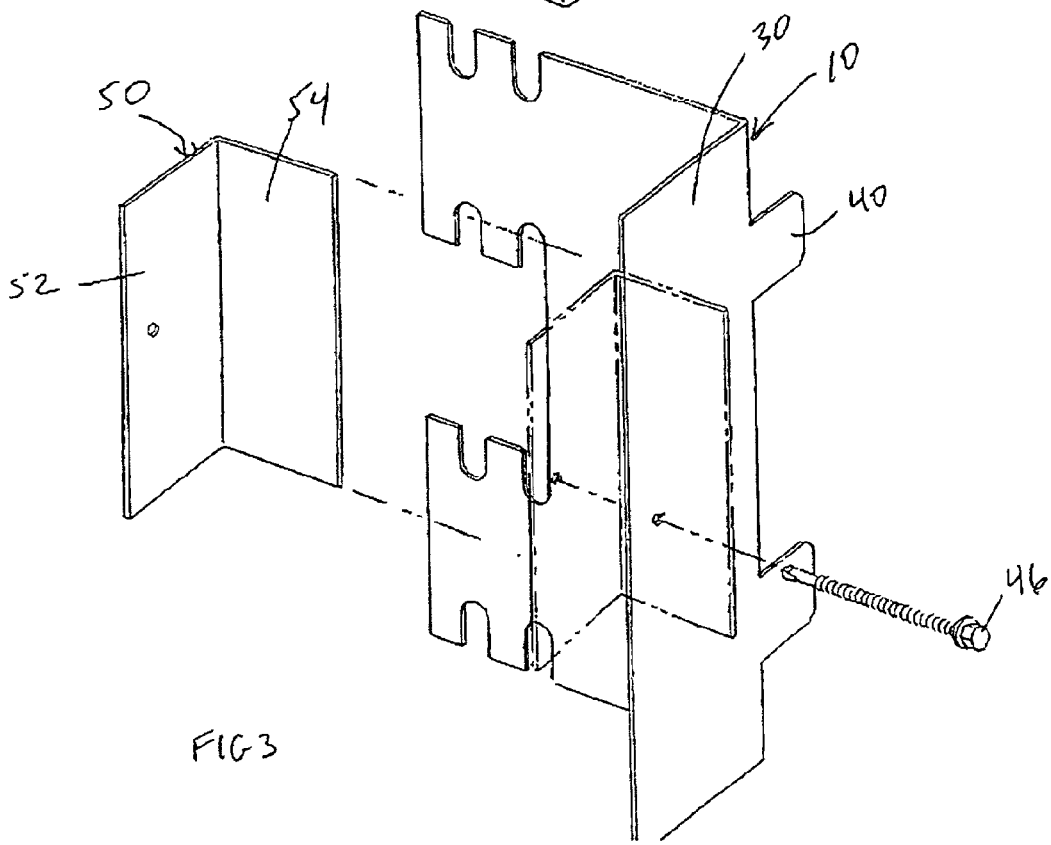
FIG. 3 is a perspective view of a variation of the bracket of FIG. 2.
Figure 4:
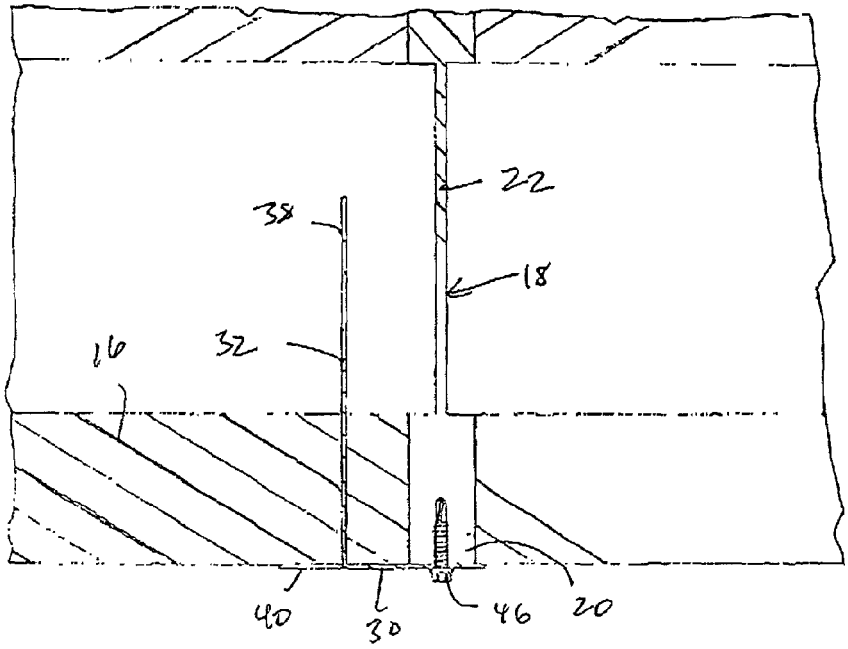
FIG. 4 is a top plan view of the bracket of FIG. 2 attached to the wall.
Figure 5:
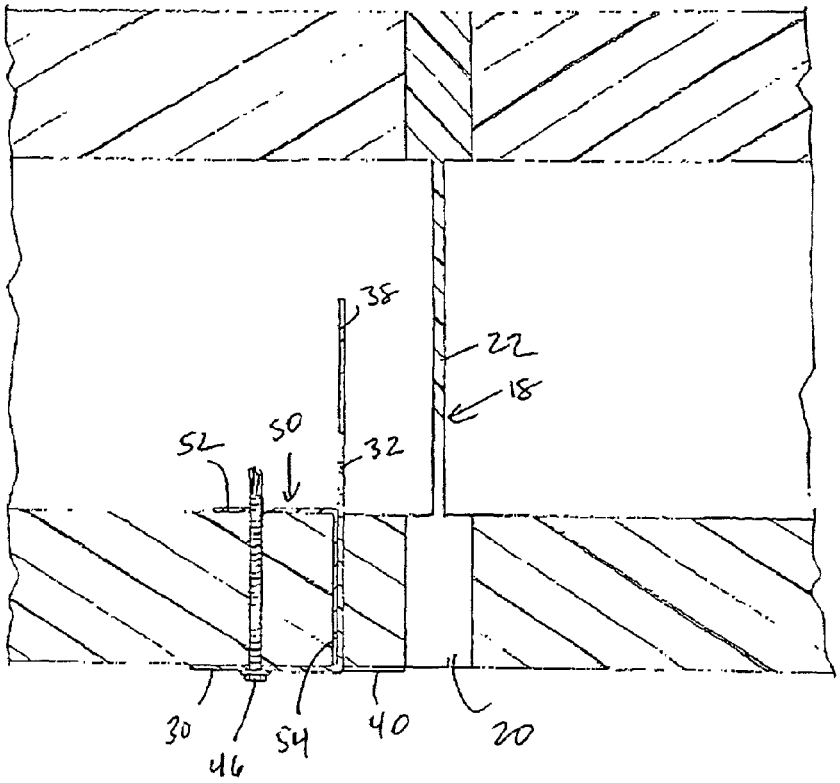
FIG. 5 is a top plan view of the bracket of FIG. 3 attached to a wall.
Figure 6:
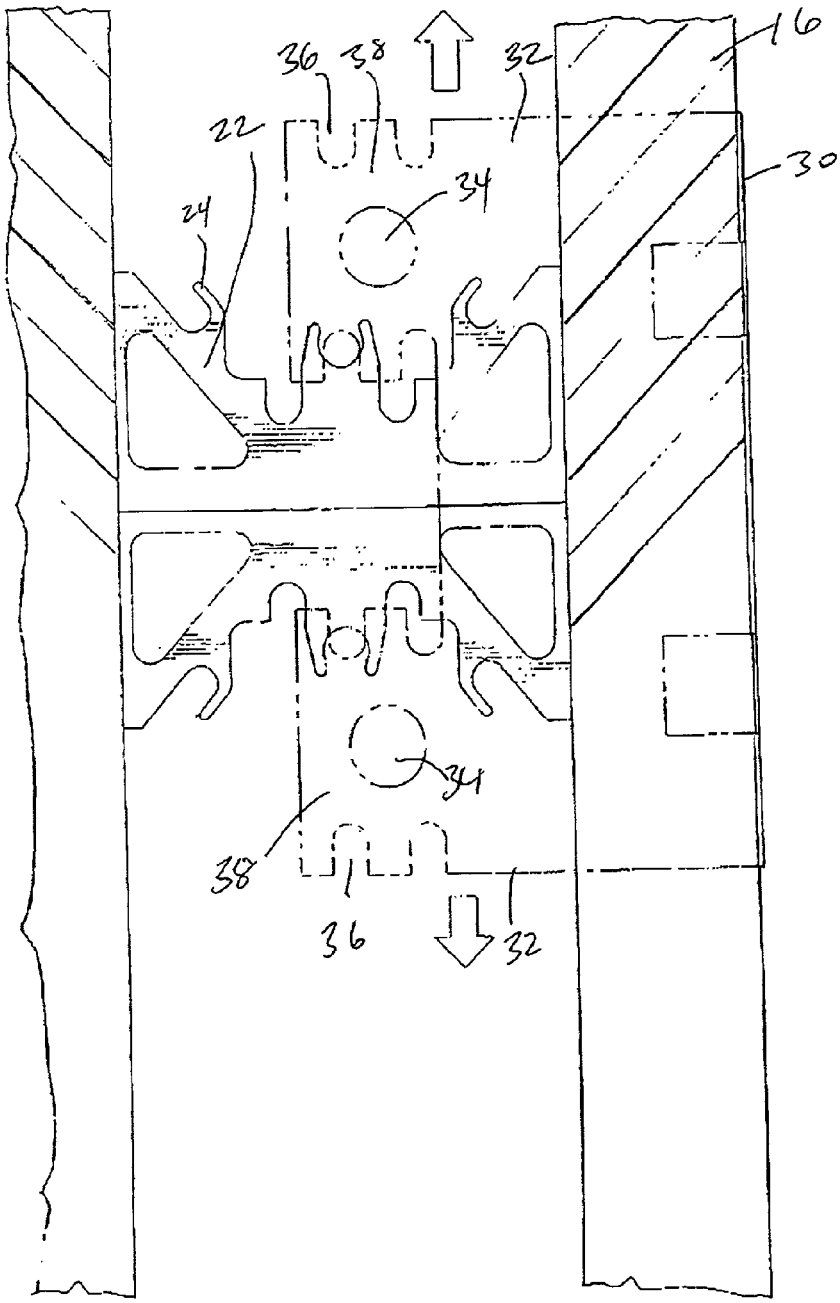
FIG. 6 is a side elevation view of the bracket of FIG. 2 attached to the wall.
Figure 7:
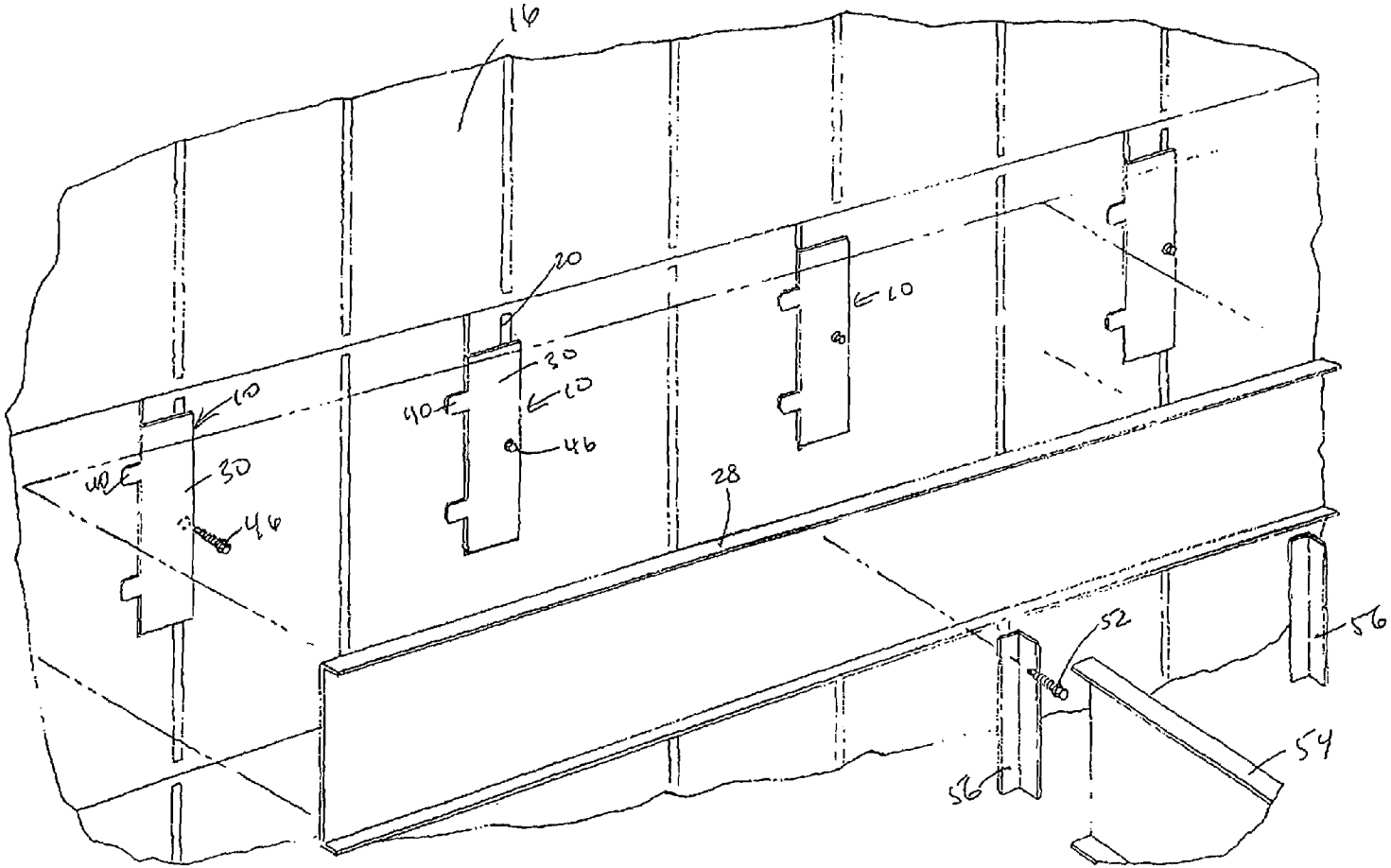
FIG. 7 is a perspective view illustrating the attachment of a steel header to the bracket and the concrete wall.
Figure 8:
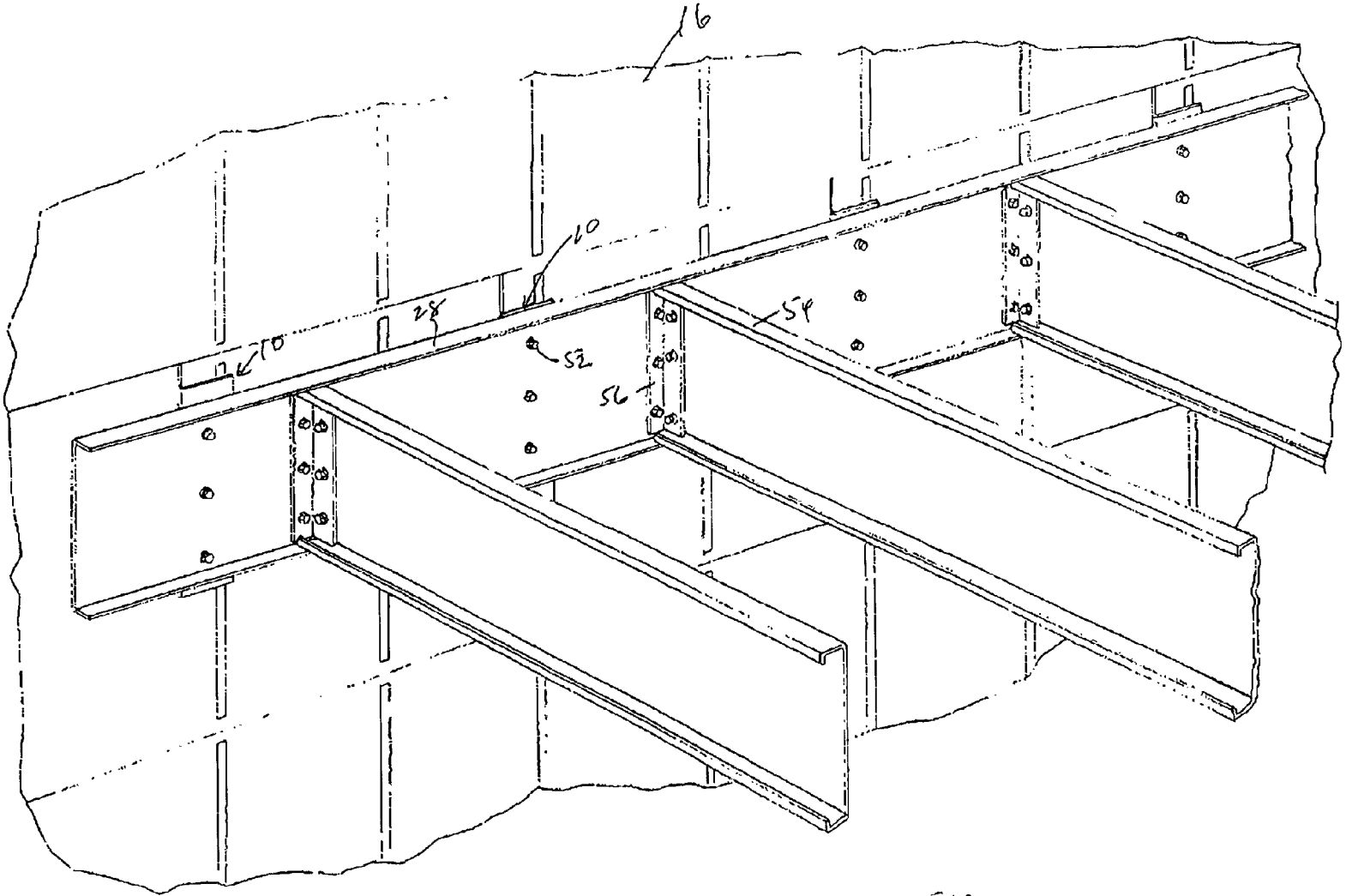
FIG. 8 is a perspective view of the header and floor joists attached to the bracket and the wall.

A preferred embodiment of a bracket according to the present invention is illustrated in the attached figures generally indicated by the numeral 10. As will be explained hereinbelow, bracket 10 is used to enable a header or rim joist for a floor structure to be attached to a concrete wall 12. As illustrated in FIG. 1, the concrete wall 12 is constructed by stacking insulated forms 14 one above the other. Forms 14 are constructed of two panels of expanded Styrofoam 16 spaced apart the appropriate distance for the thickness of the concrete wall 12. Foam panels 16 are typically on the order of about 48 inches long by about 16 inches high and two to three inches thick. Foam panels 16 are held in the proper spaced apart relationship by bridging members 18. In the concrete forms 14 illustrated in the drawings, the bridging members 18 are plastic bridging members which have elongated end plates 20 recessed into the exterior surface of the foam panels 16 and substantially flush with the exterior surface to provide a nailing surface for attachment of wall finish materials. The elongated end plates 20 are joined to one another by a plurality of web members 22. Web members 22 are provided with a series of hooked structures 24 to support steel reinforcing bars such as Rebar 26. The structure of the foam panels 16 and bridging members 18 making up the concrete form 14 illustrated in the drawings are described in U.S. Pat. No. 5,390,459 issued Feb. 21, 1995, to AAB building systems Inc. While this design of the concrete forms is illustrated in the drawings, other variations of the concrete forms are usable in the present invention as will be described herein below.

As illustrated in the figures, bracket 10 is provided with an attachment plate 30 for attachment of the header or rim joist 28 and an anchoring plate 32 for imbedment within the concrete wall 12. Preferably the bracket 10 is L-shaped with the attachment plate 30 forming the base of the L and the anchoring plate 32 extending perpendicular from one edge of the attachment plate 30 to form the leg of the L. Bracket 10 is formed by cutting and bending a blank of a suitable strength metal, preferably a 12 or 16 gauge steel sheet material. The anchoring plate 32 is preferably provided with a means of being held securely within the concrete wall 12 when the bracket 10 is subjected to the loads of the floor structure to be attached thereto. As illustrated in the figures this is accomplished in part by providing openings 34 in the anchoring plate through which the concrete can flow and provide for a continuity of concrete through the anchoring plate 32. Preferably the anchoring plate 32 is also provided with recesses 36 for supporting steel reinforcing bars 26. Recesses 36 are provided along both the top and bottom edge of the anchoring plate 32. The preferred embodiment of the anchoring plate 32 illustrated in the drawings is provided with two anchoring structures 38 located at the top and bottom edge of the anchoring plate 32 at the end distal of the attachment plate 30. These anchoring structures 38 further enhance the holding of the bracket 10 within the concrete wall 12 under load. The provision of the two anchoring structures 38 provides the anchoring plate 32 with the generally U-shaped configuration in the portion of the anchoring plate 32 embedded in the concrete. Each of the anchoring structures 38 is preferably provided with the opening 34 through which the concrete can flow as well as the recesses 36 along the top and bottom edge of the anchoring structure 38 for supporting steel reinforcing bars 26. The combination of the two anchoring structures 38 with the openings 34 and recesses 36 along with the use of the rebar provides the bracket with exceptional load carrying capacity.

The attachment plate 30 is also preferably provided with at least one extension wing 40 extending from the edge of the attachment plate 30 where the anchoring plate 32 joins the attachment plate 30. As illustrated in the drawings, preferably at least two such extension wings 40 are provided on the bracket 10, the purpose of which will be explained herein below.

The use of the bracket 10 of the present invention will now be described with reference to the attached drawings. The concrete forms 14 are stacked and installed in the traditional manner to form the height of wall 12 desired. At the desired location of the header or rim joist 28, slots 42 are cut in the foam panels 16 to accommodate the brackets 10. Preferably the slots 42 are cut in the foam panels 16 such that when the bracket 10 is installed in the slot 42, the attachment plate 30 overlies the elongated end plates 20 of the bridging member 18. The bracket 10 is installed in the wall by sliding the anchoring plate 32 through the slot 42 until the attachment plate 30 abuts the exterior surface of the foam panel 16. The bracket 10 is held in position by attaching the bracket 10 to the elongated end plates 20 of the bridging member 18. This is accomplished by screwing the attachment plate 30 to the elongated end plate 20. In order to make this easier, a hole 44 may be provided in the attachment plate 30 for insertion of the screw 46. When the bracket 10 is inserted into the slot 42, the foam panel 16 may be weakened on the side of the slot 42 away from the elongated end plate 20 of the bridging member 18. Extension wings 40 extending from the edge of the attachment plate 30 support the foam panel 16 in this weakened area to prevent the panels 16 from bulging out when the concrete is poured into the form 14. Prior to pouring the concrete into the form 14 suitable Rebar 26 may be laid into the hooked structures 24 of the web members 22 of the bridging member 18. Alternatively or in addition to this, Rebar 26 may also be placed within the recesses 36 of the anchoring structure 38. In addition Rebar 26 may also be installed through the opening 34 of the anchoring structures 38. Preferably opening 34 is of a size to allow for two steel reinforcing bars 26 to be tied together in side-by-side relationship and placed through the opening 34.

There may be instances where it is desired to install the bracket 10 in a section of the foam panels 16 which is not adjacent to one of the bridging members 18. In addition, the bracket 10 may be used with foam panels which do not have an exposed bridging member 18 to which the bracket 10 can be attached. It is however necessary to securely tie the bracket 10 to the foam panels 16 to prevent the bracket 10 from moving or being displaced away from the wall 12 while the concrete is being poured and setting. It is not easy to directly attach the bracket 10 to the foam panels 16, as the foam panel 16 does not have required strength or rigidity to properly hold a fastener such as a screw 46. In order to hold the bracket 10 in position in these circumstances, a backing plate 50 is provided which is placed on the interior surface of the foam panel 16 adjacent to the slot 42 through which the anchoring plate 32 is inserted. A screw is then inserted through the hole 44 in the attachment plate 30, through the foam panel 16 and into the backing plate 50. This securely ties the bracket 10 to the Styrofoam panel 16. Preferably for ease of installation and location of the backing plate 50, backing plate 50 is provided as an L-shaped member with the base 52 of the L being the backing plate 50 and the leg 54 of the L being insertable into the slot 42. This allows the backing plate 50 to be held in the proper position for installation of the screw 46.

When the bracket 10 is being installed within a slot 42 cut in the foam panel 16, it is a simple matter to adjust the position of the bracket 10 by sliding the bracket 10 up or down to locate the bracket 10 in the proper position on the wall for attachment of the header or rim joist 28. Once the bracket 10 has been properly located it is attached to the elongated end plates 20 of the bridging member 18 or to the backing plate 50 depending upon the location of the bracket 10. The dimensions of the header or rim joist 28 may vary depending upon the unsupported spans of the floor structure. This may vary anywhere from 6 to 10 inches depending upon the distance which must be spanned by the floor structure. In order to accommodate these various sizes of header or rim joists 28, the bracket 10 preferably has a height of about eight inches. It has been found that with this height of the bracket 10 even if the bracket 10 is not properly located on the wall 12 and is off by an inch or two, even with the larger sizes of header or rim joists 28, so long as there is an overlap between the bracket 10 and the header or rim joist 28 of least about six inches there will be a very secure attachment of the header or rim joist 28 to the bracket 10.

Once all of the brackets 10 have been installed on the wall and steel reinforcing bars 26 installed as required or desired, the concrete is poured into the hollow cavity of the wall 12 and allowed to set. Once the concrete is set, the header or rim joist 28 is attached to the brackets 10. While the headers 28 illustrated in the drawings are shown as metal headers 28, the header or rim joist 26 can also be other material such as wood. Depending upon the height of the head of the screw 46 attaching the bracket 10 to the elongated end plates 20, the screw 46 may be removed prior to installation of the header 28. Alternatively, if the head of the screw 46 does not project very far from the surface of the bracket 10 or if the header or rim joist 28 is wood, then the screw 46 may be left in position. The header 28 is placed in position on the wall 12 and attached to the brackets 10 by suitable self-tapping screws 52 screwed through the header 28 and into the bracket 10. Preferably the screws 52 are located so that they will also be attached to the elongated and plate 20 of the bridging member 18 as well as being attached to the bracket 10. As can be seen in the drawings, the elongated end plates 20 extend above and below the bracket 10 and thus may used as a guide for proper placement of the screws 52. When utilizing metal headers and floor joists 54 it is preferred that the floor joists 54 be attached to the header 28 by means of a metal bracket 56. In these circumstances, if the bracket 56 attaching the floor joists 54 to the header 28 overlies one of the brackets 10 attached to the wall 12, then the screws 52 attaching the bracket 56 to the header 28 are also utilized to attach the header 28 to the wall 12 by screwing through the bracket 56, the header 28, and then the bracket 10 attached to the wall 12. Once the header 28 and has been attached to the wall 12 and the brackets 56 attached to the header 28, the floor joists 54 are attached to the brackets 56 in the usual manner. In most installations utilizing quarter inch self-tapping screws 52 three such screws 52 at each bracket 10 are sufficient to provide for the proper load carrying capacity for the floor structure. If the header or rim joist 28 is a wood header 28, then it is attached to the brackets 10 in the same manner utilizing a suitably long self tapping screw 52 to screw through the wood header 28 and into the bracket 10.

An additional advantage of the fastening system of the present invention over the conventional prior art systems is that the fastening system utilizing the self tapping screws does not interfere with the placement of the joist hangers for wood joists. If the joist hanger happens to align with a bracket 10 then the screws 46 could be screwed through the joist hanger, the header and into the bracket 10. Even if the joist lines up with the screws attaching the header to the wall, the low height of the head of the screw does not interfere with the placement of the joist in the joist hanger.

Figure 9:
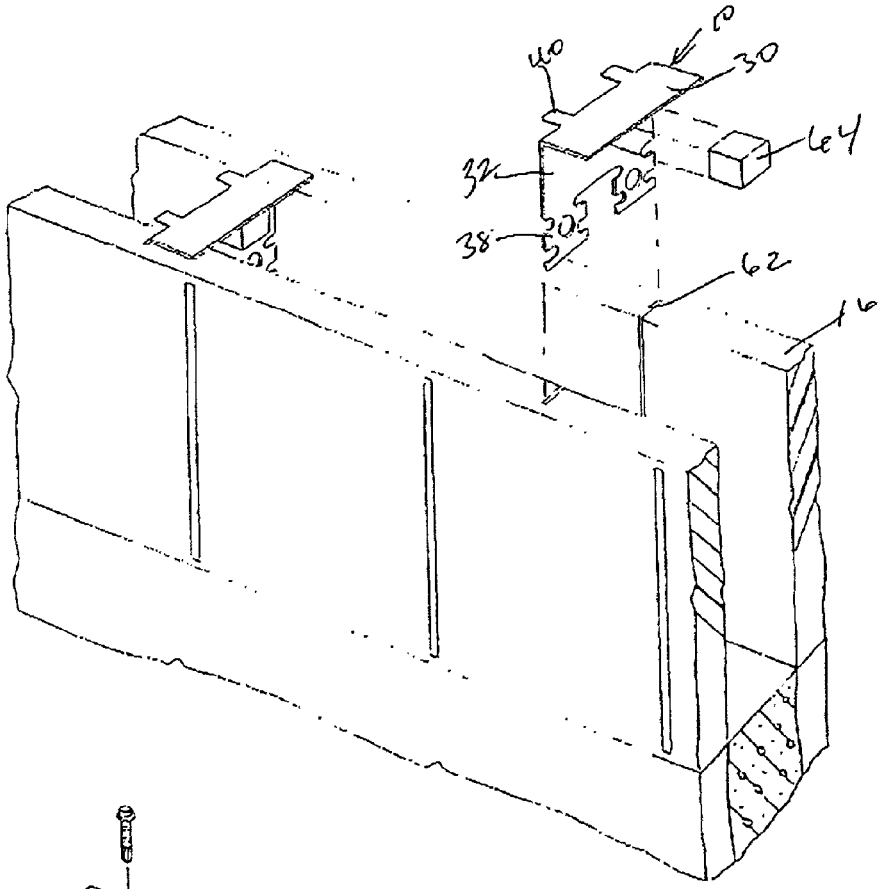
FIG. 9 is a perspective view illustrating the use of the bracket for attachment of sill plates.
Figure 10:
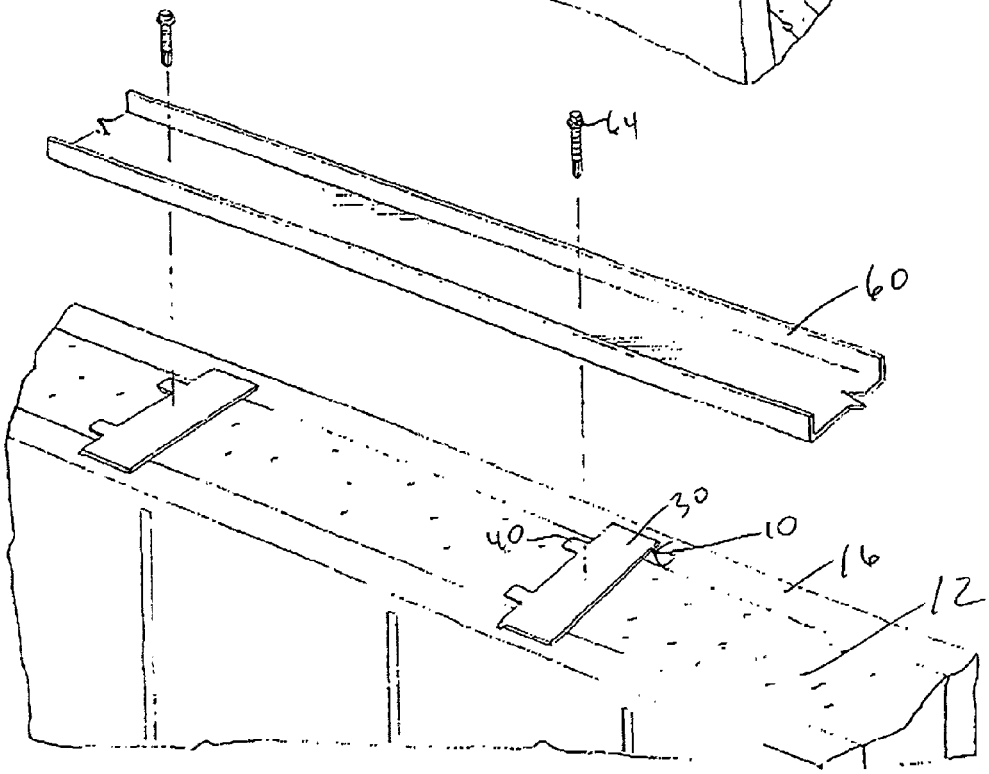
FIG. 10 is a perspective view illustrating a sill plate attached to the wall.
Figure 11:
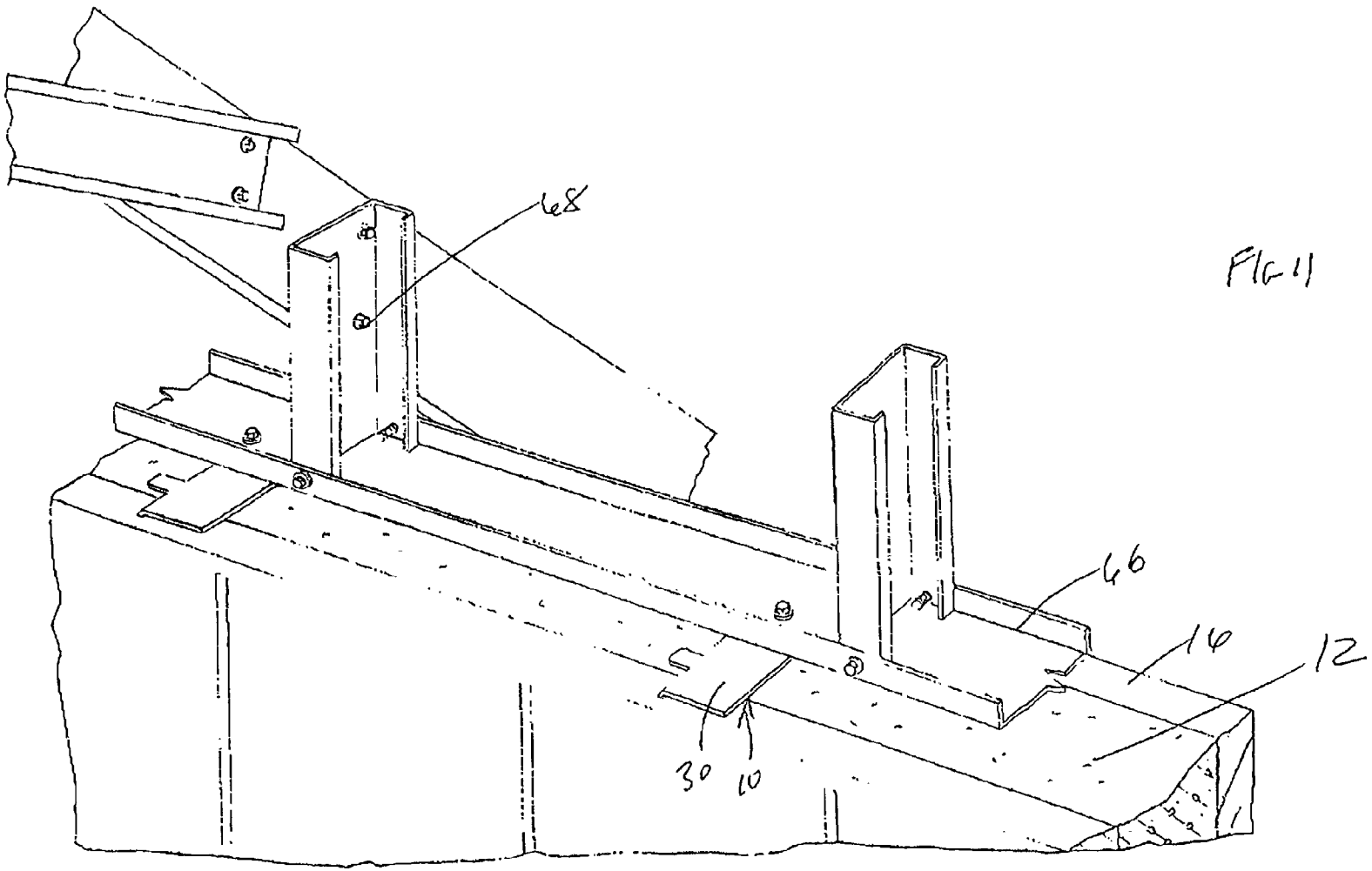
FIG. 11 is a perspective view of a roof truss arrangement attached to the top of a wall utilizing the bracket of the present invention.

The bracket 10 of the present invention may also be utilized for attachment of sill plates 60 to the top of a concrete wall 12 as illustrated in FIGS. 9 to 11. In this installation, slots 62 are cut in the interior of the foam panels 16 to accommodate the anchoring plate 32 of the bracket 10. A foam spacer block 64 is placed under the attachment plate 30 to provide for a relatively soft material so that the screws can penetrate the softer material rather than concrete and not interfere with their holding strength when the sill plate 60 is being attached to the attachment plate 32. Once the brackets 10 are installed in the wall 12, steel reinforcing bars 26 may be run through the brackets 10, the concrete poured into hollow cavity and allowed to set. The sill plate 60 is then placed in the proper position along the top of the wall and secured to the brackets 10 with properly dimensioned self-tapping screws 64.

As illustrated in FIG. 11 the brackets 10 can also be utilized for the top plate 66 of a roof truss system. Once the top plate 66 is attached to the brackets 10 in a manner as described above, the other components of the roofing system may be attached to the top plate 66 and to each other with suitable self tapping screws 68.

Figure 12:
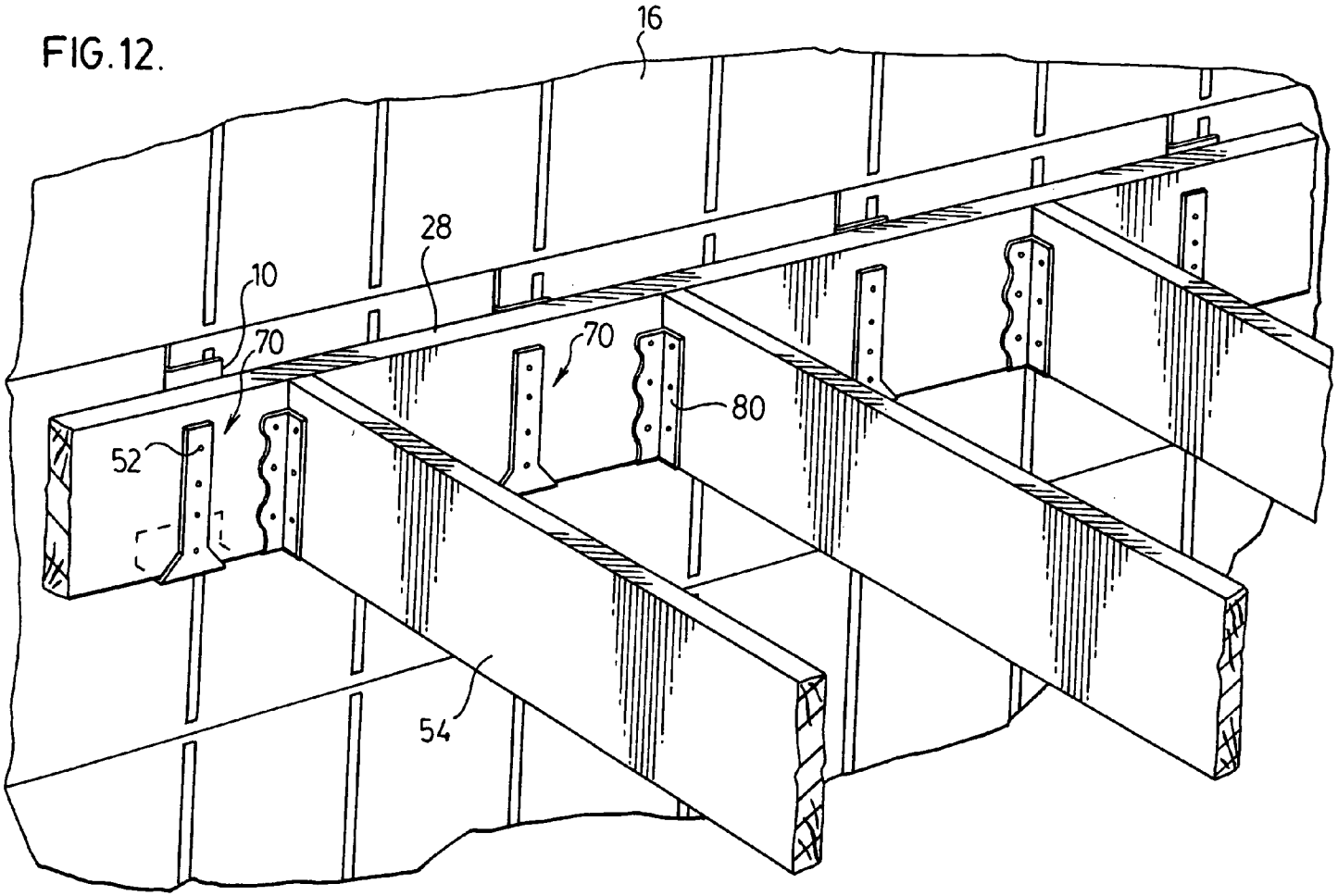
FIG. 12 is a side elevation view of a variation of the bracket of the present invention used to attach a wood sill plate to a wall.
Figure 13:
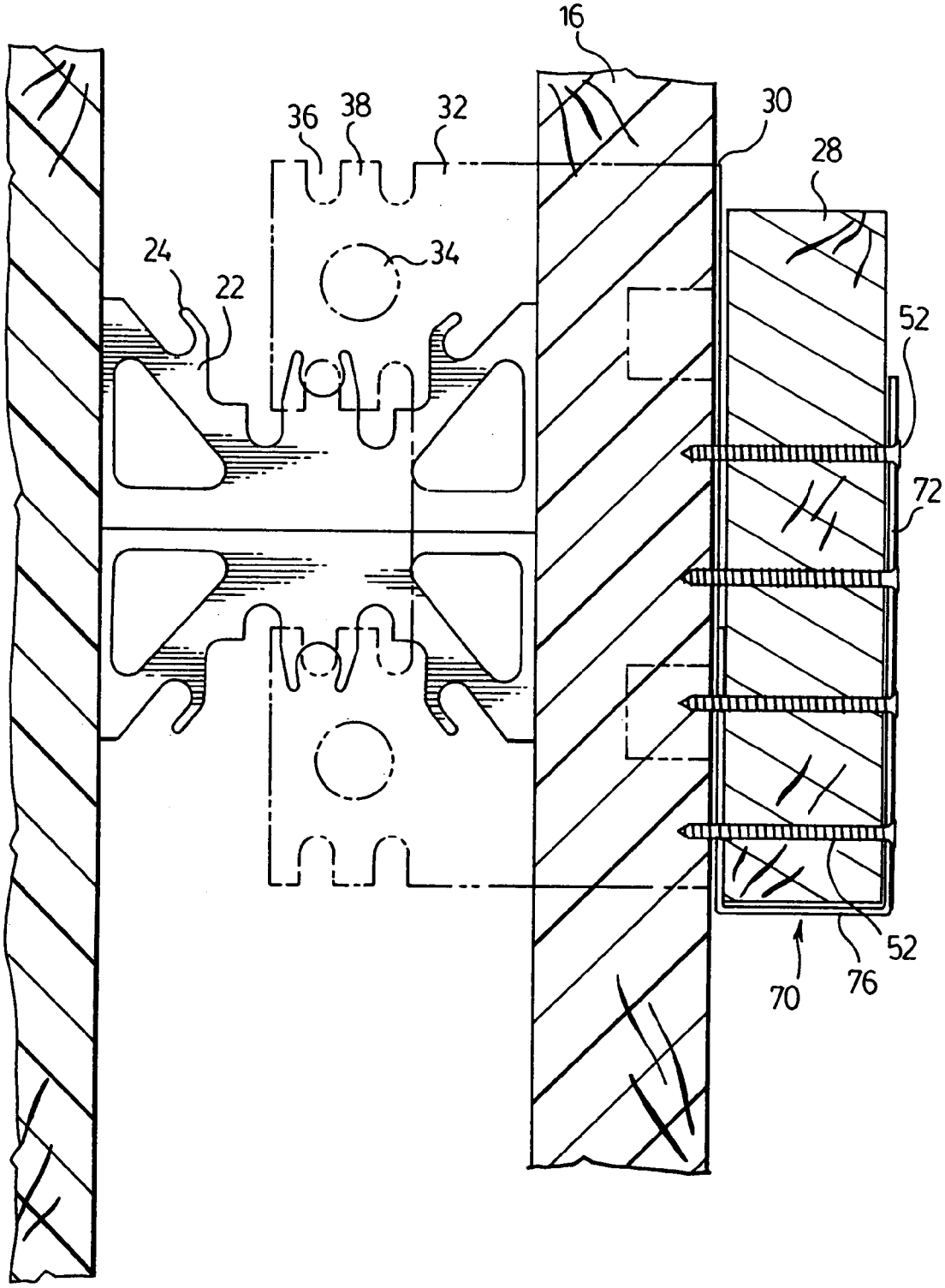
FIG. 13 is a perspective view of the variation of the bracket of FIG. 12.

When the bracket 10 of the present invention is utilized for attaching wood rim joists 28 to the concrete form wall 12 it may be desirable to provide for further support of the rim joist 28 at the point of attachment to the bracket 10. This additional support is of particular use where the installer may not utilize sufficient fasteners 52 or where there is insufficient overlap between the rim joist 28 and the bracket 10 to allow for the proper number of fasteners to be inserted through the rim joist 28 into the bracket 10. As illustrated in FIGS. 12 and 13, a U-shape saddle 70 may be utilized to support the rim joist at the point of attachment to the bracket 10. The saddle 70 is provided with a front plate 72 for abutment against the front surface of the rim joist 28. A rear plate 74 is provided which will be between the rear surface of the rim joist 28 and the attachment plate 30. A bottom 76 joins the front plate 72 and rear plate 74 at their lower edges thereof. It is preferred if the bottom 70 and rear plate 74 have an increased width compared to the front plate 72 to provide for a larger bearing surface for the rim joist 28. The front plate 72 is not as wide in order to conserve the amount of metal required to form the saddle 70. It is preferred if the lower side edges of the front plate 72 slant outwardly to join the bottom 76 to increase the strength of the saddle 70.

To attach the wood rim joist 28 to the bracket 10, the saddle 70 is placed over the lower edge of the rim joist 28 and fasteners 52 are driven through the saddle rim 70, joist 28 and into the attachment plate 30 of the bracket 10. At least one and preferably two of the fasteners 52 should be placed near the bottom of the rim joist 28 so that they may penetrate the rear plate 74 of the saddle 70, to tie the rear plate 74, tightly to the attachment surface 30 of the bracket 10. By utilizing the saddle 70, the load bearing capability of the floor constructed with the wood rim joists 28 is increased and additionally allows for greater flexibility in the vertical orientation of the rim joist 28 in relation to the positioning of the bracket 10 in the wall 12.

Once the wood rim joists 28 are installed, wood joists 54 may be installed in the conventional manner utilizing joist hanger 80.

The bracket of the present invention provides for an easy labor saving means of attaching headers and rim joists for flooring structures to an insulated concrete form wall. The brackets of the present invention are easier to install then the prior method which involves cutting out a section of the foam panel, then attaching a cover plate over the cut out section with anchor bolts attached to the cover plate. Once the concrete had been poured and set, the cover plate was removed and the header attached to the anchor bolts. In contrast, the brackets of the present invention are installed by merely cutting a slot in the foam panel, inserting the bracket and attaching the bracket to either the elongated and plate of the bridging member of the concrete form or to a backing plate 50 if the bracket does not overlie a bridging member.

The attachment of the header or rim joist using the bracket of the present invention is also much easier and less labor-intensive than the prior art system. In the prior art system it was necessary to properly locate the position of the bolts on the header or rim joist, drill the holes in the header, slide the header over the bolts and attach the header to the wall using nuts and washers on the bolts. In contrast, using the bracket of the present invention, the header or rim joist is held against the wall 1 in the proper position and screwed directly to the brackets. It is not necessary to drill holes in the header for the screws if self-tapping screws are utilized, as they will make their own hole. Thus the bracket of a present invention represents a significant labor saving for attachment of headers and rim joists to concrete walls produced using insulated concrete forms.

Although various preferred embodiments of the present invention have been described herein in detail, it will be appreciated by those of skill in the art that variations may be made thereto without departing from the spirit of the invention or the scope of the appended claims.

What is claimed is:

1. A bracket for use with a form of spaced apart insulation panels defining a cavity into which concrete is to be poured, the bracket being adapted for attaching and supporting a joist the bracket comprising a unitary metal body having a rigidity and stiffness sufficient to support the load of a joist, the bracket having a rigid, planar attachment plate for location to the exterior of an insulation panel of the form to provide for a means of attaching joist to the bracket, and a rigid, planar anchoring plate extending from the attaching plate for insertion into the cavity of the form and having at least one concrete flow passage therethrough to provide a continuity of concrete through the anchoring plate when concrete is poured into the form, the bracket being an L-shaped bracket with the attachment plate forming the base of the L and the anchoring plate extending perpendicular from one edge of the attachment plate to form the leg of the L, wherein the attachment plate is provided with at least one extension wing extending perpendicularly from the anchoring plate to the opposing side of and in the same plane as the attachment plate to provide support to the exterior of the insulation panel.

2. A bracket as claimed in claim 1 wherein the anchoring plate at the end distal the attachment plate has a generally planar U-shape to provide for two spaced apart anchoring structures located at a top and bottom of the anchoring plate.

3. A bracket as claimed in claim 2 wherein the concrete flow passage is a centrally located opening within each of the anchoring structures through which concrete can flow.

4. A bracket as claimed in claim 3 wherein the opening is of a size to allow steel reinforcing bars placed in side-by-side relationship to pass therethrough.

5. A bracket as claimed in claim 4 wherein the anchoring structures are provided with recesses along the top and bottom edges for supporting steel reinforcing bars.

6. A bracket as claimed in 1 wherein the unitary metal body is formed from a 14 to 16 gauge steel sheet.

7. A method of attaching a header or rim joist to a concrete wall constructed using a form of insulation panels into which concrete is to be poured, the method comprising cutting a vertical slot in the exterior of the insulation panel, inserting a bracket into the slot, the bracket being a unitary metal body having a rigidity and stiffness sufficient to support the load of a joist, the bracket having an attachment plate located to the exterior surface of the insulation panel and an anchoring plate extending from the attachment plate through the slot into the interior of and part way across the form and having at least one concrete flow passage to provide a continuity of concrete through the anchoring plate for embedment within the concrete, pouring concrete into the form, allowing it to set and attaching the joist to the brackets.

8. A method as claimed in claim 7 wherein the bracket is an L-shaped bracket with the attachment plate forming the base of the L and the anchoring plate extending perpendicular from one edge of the attachment plate forming the leg of the L.

9. A method as claimed in claim 8 wherein the attachment plate is provided with at least one extension wing extending perpendicularly from the anchoring plate to the opposing side of and in the same plane as the attachment plate for supporting the exterior of the insulation panel during the pouring of the concrete.

10. A method as claimed in claim 9 wherein the anchoring plate has a generally planar U-shape to provide for two anchoring structures located at the top and bottom of the anchoring plate.

11. A method as claimed in claim 10 wherein the concrete flow passage is a centrally located opening within each of the anchoring structures through which the concrete can flow.

12. A method as claimed in claim 11 wherein the opening is of a size to allow two steel reinforcing bars placed in side-by-side relationship to pass therethrough.

13. A method as claimed in claim 12 wherein the anchoring structures are provided with recesses along the top and bottom edges for supporting steel reinforcing bars.

14. A method as claimed in claim 9 wherein the unitary metal body of the bracket is formed from a 14 to 16 gauge steel sheet.

15. A building structure comprising a concrete wall constructed using insulated forms, the concrete wall including a bracket having a header or rim joist attached thereto, the bracket comprising a an L-shaped bracket of a unitary metal body being of a rigidity and stiffness sufficient to support the load of a floor through the header or rim joist, the bracket having an attachment plate forming the base of the L overlying the exterior of the insulated form to which the header or rim joist is attached, and an anchoring plate extending perpendicular from one edge of the attachment plate forming the leg of the L and extending into the interior of the insulated form and embedded within the concrete therein, the anchoring plate having an anchoring structure embedded within the concrete, the anchoring structures including a concrete flow passage providing a continuity of concrete through the anchoring plate.

16. A building structure as claimed in 15 wherein the unitary metal body is formed from a 14 to 16 gauge steel sheet.

17. A building structure as claimed in claim 16 wherein the anchoring plate is generally U-shaped with two anchoring structures located at a top and bottom of the anchoring plate, each of the anchoring structures having a concrete flow passage comprising a centrally located opening through which the concrete passes.

18. A building structure as claimed in claim 17 wherein the each of the openings have steel reinforcing bars passing therethrough.

* * * * *